US005651909A

United States Patent [19]

Taira et al.

[11] Patent Number: 5,651,909

[45] Date of Patent: Jul. 29, 1997

[54] SLIDING NOZZLE DEVICE AND SURFACE PRESSURE LOADING AND RELEASING METHOD USING SAME

[75] Inventors: Toshimitsu Taira; Takahiro Yasuda, both of Kitakyushu, Japan

[73] Assignee: Krosaki Corporation, Kitakyushu, Japan

[21] Appl. No.: 630,571

[22] Filed: Apr. 10, 1996

[30] Foreign Application Priority Data

Oct. 31, 1995 [JP] Japan ..... 7-283212

[51] Int. Cl.[6] ..... B22D 41/08

[52] U.S. Cl. ..... 222/600

[58] Field of Search ..... 222/600, 590, 222/597; 266/236

[56] References Cited

U.S. PATENT DOCUMENTS 4,953,760 9/1990 Fogilo ..... 222/600

FOREIGN PATENT DOCUMENTS 60-15429 4/1985 Japan .

63-501858 7/1988 Japan .

6-226430 8/1994 Japan .

88/01211 2/1988 WIPO .

*Primary Examiner*—Scott Kastler

*Attorney, Agent, or Firm*—Keck, Mahin & Cate

[57] ABSTRACT

A surface pressure loading and releasing mechanism in a sliding nozzle device for a molten metal vessel is used to reduce the hot manual work involved in loading and releasing surface pressure on plates and to carry out loading and releasing of the surface pressure by a simple operation. In a sliding nozzle device for applying and releasing surface pressure between plate bricks by moving an opening/closing metal frame having elastic force loading and a sliding metal frame disposed between a fixed metal frame and the opening/closing metal frame, a surface pressure block is removably disposed between brackets for mounting the opening/closing metal frame on the fixed metal frame. Surface pressure loading and releasing is carried out by moving the opening/closing metal frame, by causing a projecting portion of the sliding metal frame to project into the opening/closing metal frame, and by having a molten steel passage hole in the sliding metal frame passing therethrough abut with the opening/closing metal frame.

2 Claims, 4 Drawing Sheets

SLIDING NOZZLE DEVICE AND SURFACE PRESSURE LOADING AND RELEASING METHOD USING SAME

BACKGROUND OF THE INVENTION

1. Field of the Invention

This invention relates to a sliding nozzle device for a molten metal vessel, and particularly to a mechanism for effecting loading and releasing of surface pressure between a sliding plate and a fixed plate.

2. Description of the Related Art

Sliding nozzle devices provided on various kinds of molten metal vessels are widely used because they enable a flow passage for pouring molten steel or the like from inside a molten metal vessel to be opened and closed as necessary, and they allow the flowrate of molten metal to be controlled accurately.

Among such sliding nozzle devices there are two-plate types, having an upper fixed plate and a lower sliding plate, and three-plate types, having a sliding plate disposed between two fixed plates. Also, to prevent molten steel from getting between these plates, the devices are provided with mechanisms for applying surface pressure to the sliding surfaces of the plates. This surface pressure is set to a value that does not hinder the operation of the sliding nozzle device.

As a surface pressure loading mechanism for applying a surface pressure, coil springs are usually used, and as a mechanism for loading and releasing this surface pressure, a bolt tightening system is employed; however, mechanisms of various other types have also been proposed.

For example, in Japanese Unexamined Patent Publication No. Sho 63-501858, with the object of lightening the work involved in loading a surface pressure, a method of performing surface pressure loading by utilizing a taper of a sliding liner is disclosed.

However, with devices using this method, because a sliding plate must be moved in the direction of the taper of the sliding liner, restrictions are placed on the opening and closing directions of an opening/closing metal frame which holds the plate and restrains the mechanism for doing this on the underside of the molten metal vessel. There are also restrictions on where a cylinder for driving the sliding plate can be mounted, causing problems in removal and fitting thereof.

In Japanese Patent Publication No. Sho 60-15429, there is disclosed a device using a method wherein a coil spring is mounted at the bottom of a cassette, as a surface pressure loading mechanism, and surface pressure is loaded and released by engagement and disengagement of the cassette. However, in a device using this method there is the problem in that the cassette is heavy, requiring a large engaging and disengaging apparatus.

Also, the present inventors have proposed, in Japanese Unexamined Patent Publication No. Hei 6-226430, a device wherein elastic force loading means and a sliding metal frame are disposed between a fixed metal frame and an opening/closing metal frame and surface pressure between plate bricks is loaded and released by moving the opening/closing metal frame, which is itself is connected to and made to slide by a hydraulic cylinder rod for driving the sliding metal frame.

In this device, a recessed portion is provided in the rod of the hydraulic cylinder and a block attached to the opening/closing metal frame is engaged/disengaged with this recess portion. When the block is engaged with the rod, the hydraulic cylinder and the opening/closing metal frame are connected and surface pressure can be loaded or released. When the block is disengaged from the rod and connected to the fixed metal frame, control of the aperture of a pouring hole in a sliding plate becomes possible with the sliding metal frame only.

However, in this device, when the opening/closing metal frame and the hydraulic cylinder are connected, because of variations in joint parts caused by distortion of the block and fluctuations in the hydraulic system due to heat, there are problems in engagement and disengagement of the block. Also, because this block is partly a transmitting force, it must bear several tons of force during loading; consequently manual operation is difficult and the device tends to be large.

SUMMARY OF THE INVENTION

An object of the invention is to provide, in a sliding nozzle device for loading and releasing surface pressure between upper and lower plates by moving an opening/closing metal frame having an elastic force loading means and a sliding metal frame disposed between a fixed metal frame and the opening/closing metal frame, a surface pressure loading and releasing mechanism with which it is possible to reduce hot manual work involved in loading and releasing the surface pressure on the plates and to carry out loading and releasing of the surface pressure by a simple operation.

To achieve this and other objects, the invention provides a sliding nozzle device for loading and releasing surface pressure between plate bricks by moving an opening/closing metal frame having an elastic force loading means and a sliding metal frame disposed between a fixed metal frame and the opening/closing metal frame, characterized in that surface pressure blocks are removably disposed between brackets of the opening/closing metal frame and the fixed metal frame for mounting the opening/closing metal frame on the fixed metal frame.

In a device of this construction, surface pressure loading and releasing can be carried out by moving the opening/closing metal frame by projecting a portion of the sliding metal frame into the opening/closing metal frame and by causing a molten steel passage hole in the sliding metal frame passing therethrough to abut with the opening/closing metal frame.

By removing the surface pressure blocks from between these brackets, the opening/closing metal frame is enabled to move the distance between the brackets. The opening/closing metal frame is moved by causing the projecting portion of the sliding metal frame to abut with a portion of the opening/closing metal frame. By moving the opening/closing metal frame back and forth within this range of movement, the elastic force loading means is actuated and loading and releasing of the surface pressure on the plate bricks is carried out.

DESCRIPTION OF PREFERRED EMBODIMENTS

Figure 1:
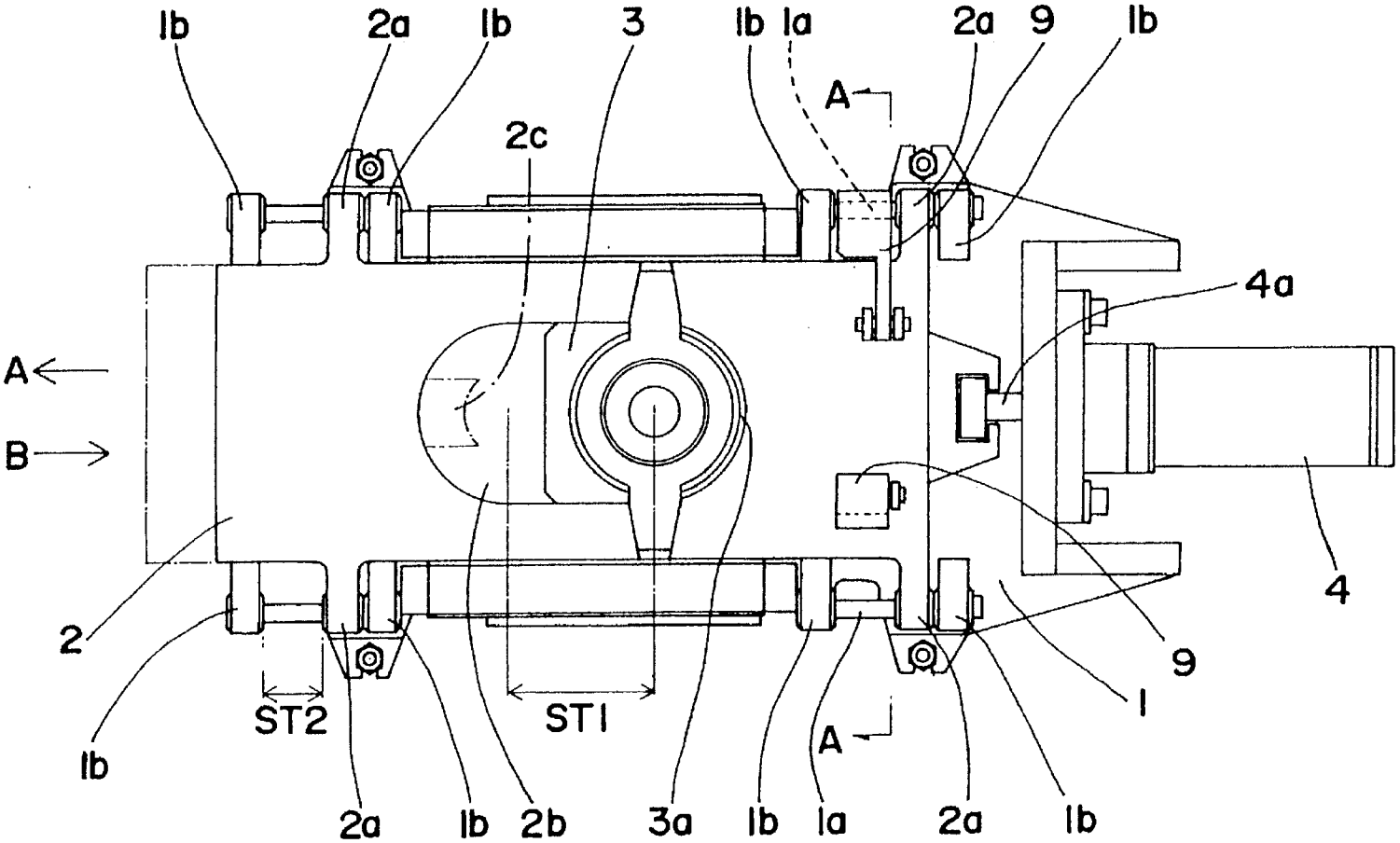
FIG. 1 is a bottom view of a preferred embodiment of a sliding nozzle device having a surface pressure loading mechanism according to the invention.
Figure 2:
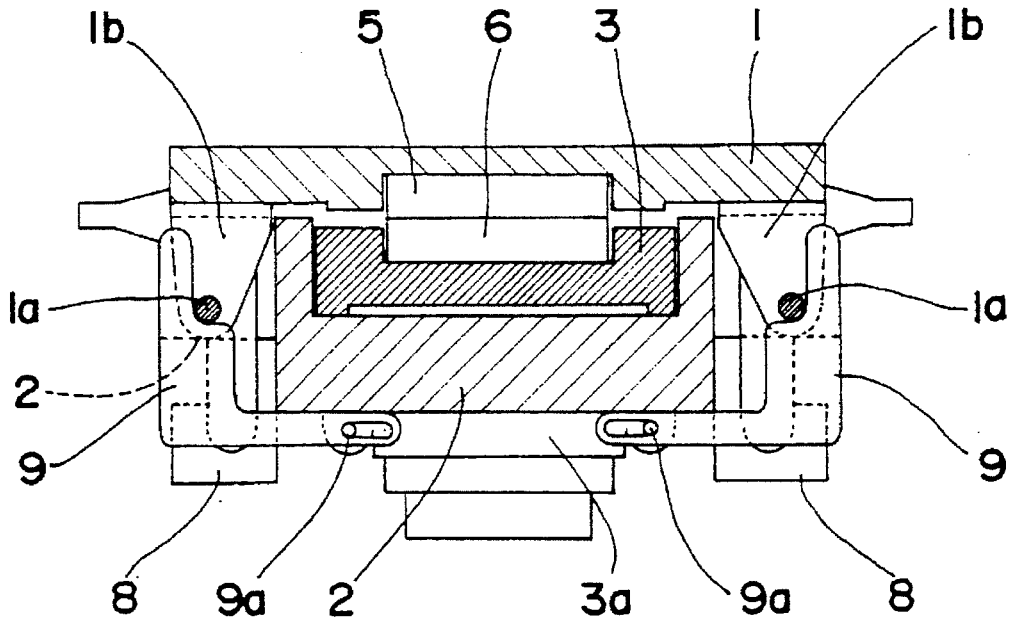
FIG. 2 is a vertical sectional view along the line A—A in FIG. 1.

FIG. 1 is a bottom view of a preferred embodiment of a sliding nozzle device having a surface pressure loading mechanism according to the invention, and FIG. 2 is a vertical sectional view along the line A—A in FIG. 1.

As shown in the drawings, an opening/closing metal frame 2 is mounted movably in the directions of the arrows A and B in FIG. 1 on a fixed metal frame 1 fixed to the bottom of a molten metal vessel, and a sliding metal frame 3 is mounted movably in the same directions as the opening/closing metal frame 2 between the fixed metal frame 1 and the opening/closing metal frame 2.

To make the opening/closing metal frame 2 movable with respect to the fixed metal frame 1, hinge shafts 1*a* oriented in the direction of movement of the opening/closing metal frame 2 are mounted in four locations on the fixed metal frame 1 between brackets 1*b* provided integrally with the fixed metal frame 1. The opening/closing metal frame 2 is provided with brackets 2*a* through which these hinge shafts 1*a* pass, and the opening/closing metal frame 2 is mounted on the fixed metal frame 1 movably with respect thereto by way of these hinge shafts 1*a* and brackets 2*a*. The stroke of movement of the opening/closing metal frame 2 is the distance moved by the brackets 2*a* between the respective pairs of brackets 1*b* of the fixed metal frame 1, and is shown in FIG. 1 as the distance ST2.

A fixed plate 5 is held in the fixed metal frame 1 and a sliding plate 6 is similarly held in the sliding metal frame 3 with its upper surface as a sliding surface which slides with respect to the fixed plate 5. The sliding metal frame 3 is linked to a rod 4*a* of a cylinder 4 and is driven forward and backward through a stroke ST1 in the directions of the arrows A and B in FIG. 1 by forward and backward movements of this rod 4*a;* the sliding metal frame 3 also has a projecting portion 3*a* on its bottom which passes through an elliptical movement hole 2*b* provided in the opening/closing metal frame 2 and projects below the lower surface of the opening/closing metal frame 2; a lower nozzle can be attached to this projecting portion 3*a*.

Figure 3A:
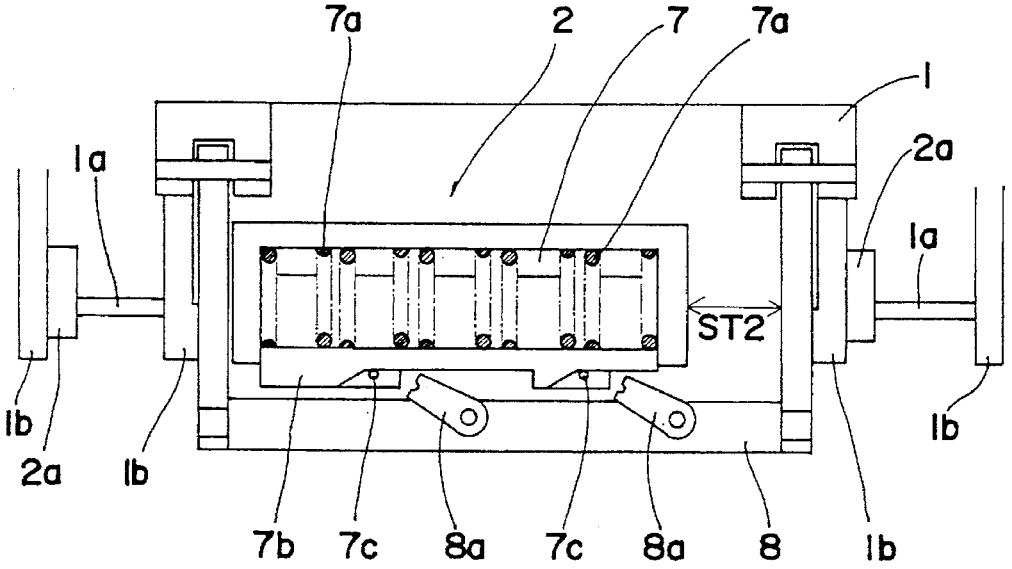
FIG. 3A and FIG. 3B are outline views of a mechanism for linking an opening/closing metal frame to a fixed metal frame to apply surface pressure, FIG. 3A showing the state of the surface pressure loading mechanism when the surface pressure has been released and FIG. 3B showing the state of the surface pressure loading mechanism when the surface pressure has been applied.
Figure 3B:
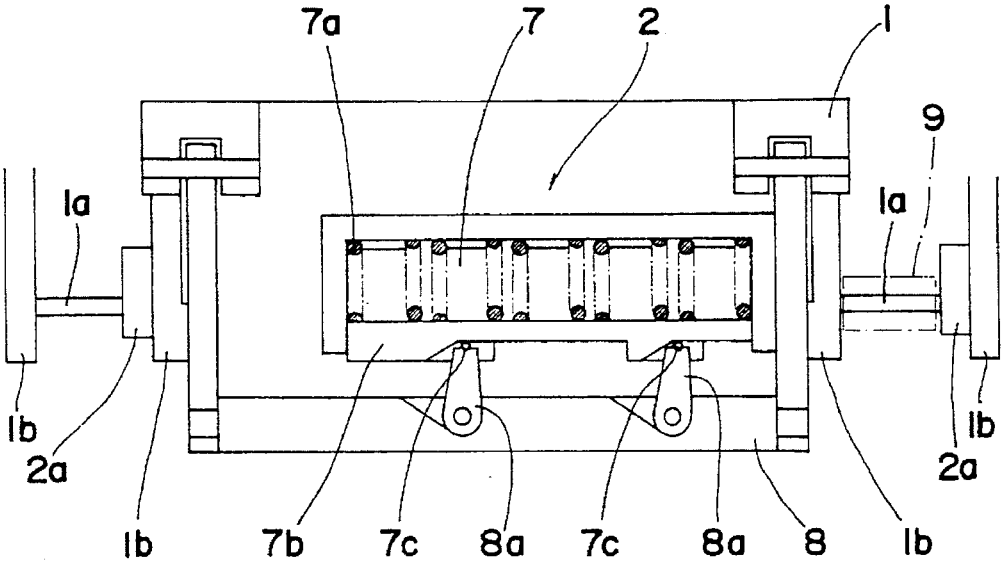

FIGS. 3A and 3B are outline views of surface pressure loading mechanism for applying a surface pressure between the fixed plate 5 and the sliding plate 6.

Like those used in conventional sliding nozzles, this surface pressure loading mechanism has a pair of spring chambers 7 disposed in the sides of the opening/closing metal frame 2 and hangers 8 shaft-connected to the fixed metal frame 1 and engageable with these spring chambers 7. The spring chambers 7 house a plurality of compression coil springs 7*a* and have an operating block 7*b* mounted movably in the vertical direction of the drawings and urged downward by these coil springs 7*a*. The fixed metal frame 1 has integral hangers 8 shaped so that they extend below the spring chambers 7, and two sets of toggle pins 8*a* are attached to the lower end portions of the hangers 8 pivotally in a vertical direction. To lift these toggle pins 8*a* from the position in which they are shown in FIG. 3A to that in which they are shown in FIG. 3B, engaging pins 7*c* are provided on the bottom of the operating block 7*b*.

In this preferred embodiment, positional relationships of parts of the surface pressure loading mechanism in its operating attitude have been discussed, but actual surface pressure loading and releasing operations are performed with the molten metal vessel tipped 90°. That is, the sliding nozzle device of this preferred embodiment is designed to be operated in a vertical state with the cylinder 4 at the top, and if surface pressure loading and releasing are to be carried out with the sliding nozzle device in some other attitude then toggle pins 8*a* of the surface pressure loading mechanism should be kept in the positions in which they are shown in FIG. 3A by means such as springs.

FIG. 3A shows the state of the surface pressure loading mechanism when the surface pressure has been released. When the cylinder 4 moves the sliding metal frame 3 in the direction of the arrow B in FIG. 1, the opening/closing metal frame 2 moves integrally with the sliding metal frame 3. Consequently, as shown in FIG. 3A, the spring chambers 7 integral with the opening/closing metal frame 2 also move with respect to the fixed metal frame 1 to the right in the drawings, and this causes the toggle pins 8*a* to engage with the engaging pins 7*c* and pivot upward to lift the operating block 7*b*. As a result, the elastic reaction forces of the coil springs 7*a* act to push the opening/closing metal frame 2 against the fixed metal frame 1 and consequently a surface pressure is applied between the sliding surfaces of the fixed plate 5 and the sliding plate 6. This surface pressure is released by the opening/closing metal frame 2 being moved to the left in the drawings and the surface pressure loading mechanism is thereby returned to the state shown in FIG. 3A.

Figure 4:
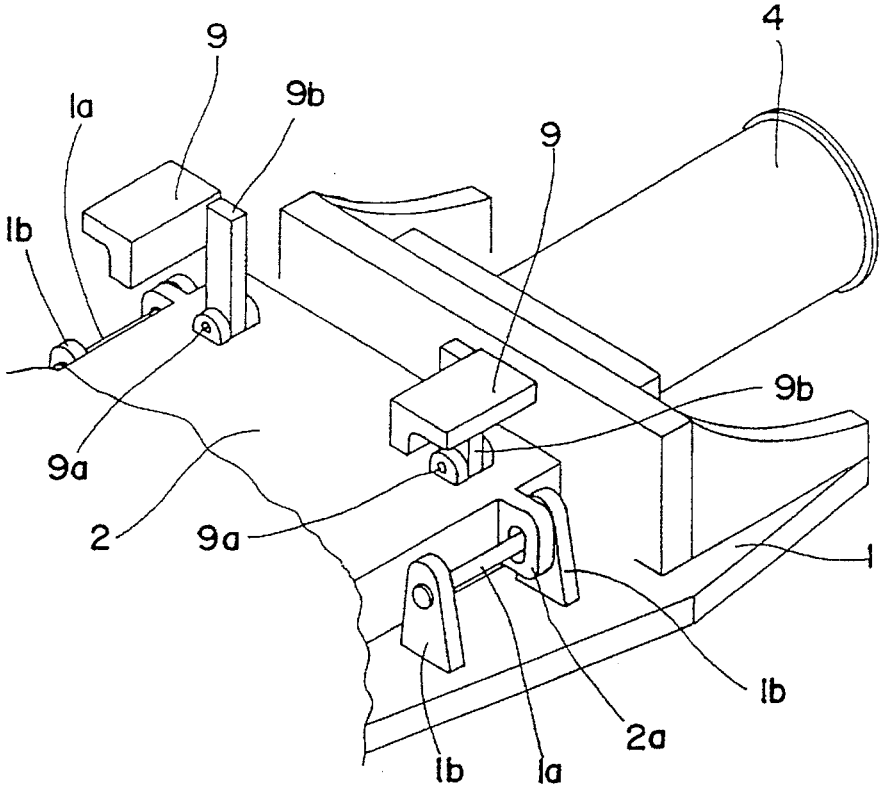
FIG. 4 is a perspective view of the opening/closing metal frame as seen from below, and shows surface pressure blocks disengaged from hinge shafts.
Figure 5:
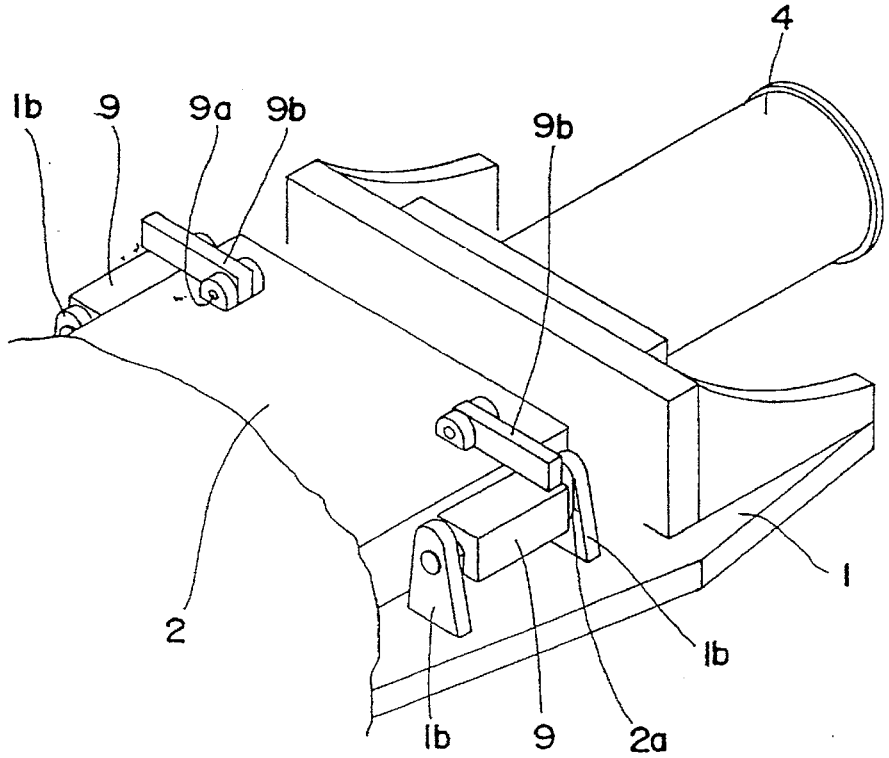
FIG. 5 is a perspective view of the opening/closing metal frame as seen from below, and shows the surface pressure blocks engaged with hinge shafts and positioned between brackets of the fixed metal frame and the opening/closing metal frame.

Returning to FIG. 1 and FIG. 2, a pair of surface pressure blocks 9 are pivotally mounted on the bottom of the opening/closing metal frame 2 near the brackets 2*a* positioned at the cylinder 4 end of the sliding nozzle device. As shown in FIG. 4 and FIG. 5, these surface pressure blocks 9 are mounted on the ends of arms 9*b* whose other ends are pivotally attached to the opening/closing metal frame 2 by means of pins 9*a*, and consequently the surface pressure blocks 9 can be set in the attitudes shown in FIG. 4 wherein they hang down from the bottom of the opening/closing metal frame 2, and in the attitudes shown in FIG. 5 wherein they are engaged with the hinge shafts 1*a* of the fixed metal frame 1.

The surface pressure blocks 9 are of such a size that when the opening/closing metal frame 2 has moved as far to the right as it can, the surface pressure blocks 9 fit snugly between the brackets 2*a* at the right hand end of the opening/closing metal frame 2 and the brackets 1*b* of the fixed metal frame 1 to the left of these brackets 2*a*. By setting these surface pressure blocks 9 in the attitudes shown in FIG. 5, wherein they are engaged with the hinge shafts 1*a* of the fixed metal frame 1, the opening/closing metal frame 2 is prevented from moving to the left in FIG. 1 by the surface pressure blocks 9 thus interposed between the respective brackets 2*a* and 1*b*.

In the example shown in the drawings, the surface pressure blocks 9 are mounted on the opening/closing metal frame 2; however, the surface pressure blocks 9 may alternatively be mounted on the fixed metal frame 1 interposably between the brackets 1*b* of the fixed metal frame 1 itself and the brackets 2*a* of the opening/closing metal frame 2 in the same way as those shown in FIG. 4 and FIG. 5. The surface pressure blocks 9 may even be mounted on the bottom of the molten metal vessel itself, as long as they are interposed between these brackets 1*b*, 2*a*.

In the construction described above, when the surface pressure blocks 9 are set in the attitude in which the lower block 9 in FIG. 1 and both the surface pressure blocks 9 in FIG. 4 are shown wherein they are disengaged from the hinge shafts 1*a* and hang down from the bottom of the opening/closing metal frame 2, the engagement of the surface pressure blocks 9 with the brackets 2*a* at the right hand end of the opening/closing metal frame 2 is released. Consequently, the opening/closing metal frame 2 can move freely in the directions of the arrows A and B in FIG. 1 and it is possible to set the opening/closing metal frame 2 in the position illustrated by the solid lines in FIG. 1 wherein a surface pressure is applied and in the position illustrated by the dotted line in FIG. 1 wherein the surface pressure is released.

To apply the surface pressure, the opening/closing metal frame 2 in the position shown with a dotted line in FIG. 1 is moved from this position, wherein the surface pressure is released, to the position wherein the surface pressure is applied by the sliding metal frame 3 being moved to the right by the cylinder 4. When this happens, the projecting portion 3*a* of the sliding metal frame 3 moves in the elliptical movement hole 2*b* until it abuts with the right hand end of this movement hole 2*b*, whereupon the opening/closing metal frame 2 starts to move integrally with the sliding metal frame 3 to the position shown with solid lines in FIG. 1 wherein the surface pressure is applied. Consequently, as explained above with reference to FIG. 3, as a result of the linkage of the operating block 7*b* of the spring chambers 7 with the hangers 8, a force pushing together the fixed metal frame 1 and the sliding metal frame 3 is produced, and consequently a surface pressure is applied between the fixed plate 5 and the sliding plate 6.

Here, as shown in FIG. 5, the surface pressure blocks 9 are inserted between the brackets 1*b* of the fixed metal frame 1 and the brackets 2*a* of the opening/closing metal frame 2 and made to engage with the hinge shafts 1*a* between these brackets 1*b*, 2*a*. The surface pressure blocks 9 can be held against the hinge shafts 1*a* by pins being provided projecting from the faces of the surface pressure blocks 9 facing the hinge shafts 1*a*, with these pins being fitted into radial holding holes provided in the hinge shafts 1*a*.

When the surface pressure blocks 9 are set in this fashion, the opening/closing metal frame 2 is prevented from moving and is held in the position shown in FIG. 1. Therefore, after surface pressure loading is carried out, the cylinder 4 can be operated and the sliding metal frame 3 can be shifted to the left in FIG. 1, and the position of the sliding plate 6 with respect to the fixed plate 5 can be changed, as the sliding plate 6 is held integrally by this sliding metal frame 3. As a result, it is possible to control the aperture of a molten steel pouring hole between the sliding plate 6 and the fixed plate 5 with surface pressure loading by the spring chambers 7 integrally with the opening/closing metal frame 2 maintained, and leakage of molten steel during this aperture control can be completely prevented.

To release the surface pressure, the surface pressure blocks 9 are removed from the hinge shafts 1*a* as shown in FIG. 4 and the restraint of the opening/closing metal frame 2 is thereby released, making the opening/closing metal frame 2 movable with respect to the fixed metal frame 1. Next, an auxiliary block 2*c* is set at the left hand end of the movement hole 2*b* of the opening/closing metal frame 2, and before the sliding plate 6 is brought to the end of its stroke by the cylinder 4 the left side of the projecting portion 3*a* of the sliding metal frame 3 is abutted with the auxiliary block 2*c* and the opening/closing metal frame 2 is thereby removed to the position shown by the dotted line in FIG. 1. This movement of the opening/closing metal frame 2 shifts the sliding nozzle device from the state shown in FIG. 3B to the initial state shown in FIG. 3A and this also simultaneously releases the surface pressure.

Alternatively the stroke of the cylinder 4 could be extended by the length of the auxiliary block 2*c*, which could then be dispensed with, but because the opening/closing metal frame 2 is then subjected to the thrust of the cylinder 4 during aperture control it would be necessary to increase the strength and size of the opening/closing metal frame 2. Consequently, from the point of view of reducing the size of the sliding nozzle device, this method is not preferable.

Some benefits provided by the invention are:

(1) Because it is possible to stop the movement of the opening/closing metal frame while a surface pressure is being applied between plate surfaces, the sliding metal frame can be moved with the surface pressure still applied.

(2) The surface pressure blocks are just inserted between brackets and, because these blocks are small and light, operation is simplified and hot work can be reduced.

(3) Surface pressure loading and releasing can be carried out by movement of the opening/closing metal frame, thus simplifying automation.

(4) Because no special mechanism is required to move the opening/closing metal frame, the device is compact.

(5) Because conventional brackets are used for mounting the opening/closing metal frame, the device is compact.

What is claimed is:

1. A sliding nozzle device for applying and releasing surface pressure between plate bricks comprising:

a fixed metal frame, an opening/closing metal frame slidably connected to said fixed metal frame, elastic force loading means for applying and releasing a force between the opening/closing metal frame and the fixed metal frame, a sliding metal frame disposed between said fixed metal frame and the opening/closing metal frame, means for driving said sliding metal frame and causing said elastic force loading means to apply and release said force, and a surface pressure block, removably disposed between a bracket of the fixed metal frame and a bracket of the opening/closing metal frame for mounting the opening/closing metal frame onto the fixed metal frame, for preventing relative movement of the opening/closing metal frame and the fixed metal frame.

2. A sliding nozzle device according to claim 1, and further comprising a protecting portion of the sliding metal frame defining a molten steel passage hole and protecting into the opening/closing metal frame, wherein surface pressure applying and releasing is carried out by sliding the opening/closing metal frame relative to said fixed metal frame as the projection defining the molten steel passage hole abuts with the opening/closing metal frame.

* * * * *